US008049584B2

(12) United States Patent
Mueller et al.

(10) Patent No.: US 8,049,584 B2
(45) Date of Patent: Nov. 1, 2011

(54) SWITCHING DEVICE

(75) Inventors: Ralf Mueller, Germersheim (DE); Frank Hustert, Waghaeusel (DE); Ralph Burckhardt, Neckargemuend (DE); Guido Niewoehner, Wiesloch (DE); Hans-Peter Weyand, Belheim (DE)

(73) Assignee: ABB AG, Mannheim (DE)

( * ) Notice: Subject to any disclaimer, the term of this patent is extended or adjusted under 35 U.S.C. 154(b) by 252 days.

(21) Appl. No.: 12/395,064

(22) Filed: Feb. 27, 2009

(65) Prior Publication Data

US 2009/0219662 A1 Sep. 3, 2009

(30) Foreign Application Priority Data

Mar. 1, 2008 (DE) ..... 10 2008 012 149

(51) Int. Cl.
*H01H 9/00* (2006.01)
*H01H 83/00* (2006.01)

(52) U.S. Cl. ..... 335/176; 335/21; 335/172; 335/174; 335/255

(58) Field of Classification Search ..... 335/6, 8–10, 335/21, 35, 38, 43, 54, 57, 63, 65, 68, 77, 335/82, 102, 106, 126, 167–176, 172, 173, 335/174, 192, 195, 202, 220, 229, 230, 249, 335/251, 255, 258, 260, 261, 262, 273, 279, 335/281, 298; 361/159, 194
See application file for complete search history.

(56) References Cited

U.S. PATENT DOCUMENTS

| | | | | | |
|---|---|---|---|---|---|
| 4,062,052 | A | * | 12/1977 | Harper et al. | 361/28 |
| 4,250,477 | A | * | 2/1981 | Graninger et al. | 335/169 |
| 4,288,769 | A | * | 9/1981 | Howell | 335/173 |
| 4,617,540 | A | * | 10/1986 | Westermeyer | 335/35 |
| 4,697,163 | A | * | 9/1987 | Grunert et al. | 335/174 |
| 4,713,639 | A | * | 12/1987 | Grunert et al. | 335/172 |
| 4,973,928 | A | * | 11/1990 | Grunert | 335/38 |
| 5,831,501 | A | * | 11/1998 | Kolberg et al. | 335/42 |
| 5,894,257 | A | | 4/1999 | Roger et al. | |
| 6,300,853 | B1 | * | 10/2001 | Grafenhahn et al. | 335/176 |
| 6,940,373 | B2 | * | 9/2005 | Hintz et al. | 335/31 |

FOREIGN PATENT DOCUMENTS

| | | | | |
|---|---|---|---|---|
| DE | 198 45 476 | A1 | | 4/2000 |
| DE | 19935662 | | | 2/2001 |
| DE | 10002773 | A1 | * | 7/2001 |
| DE | 697 18 265 | T2 | | 8/2003 |
| DE | 10 2005 020167 | A1 | | 11/2006 |
| DE | 600 32 137 | T1 | | 10/2007 |
| EP | 501844 | A1 | * | 9/1992 |
| EP | 0 569 652 | A | | 11/1993 |
| EP | 1073083 | A2 | * | 1/2001 |

* cited by examiner

*Primary Examiner* — Anh Mai
*Assistant Examiner* — Mohamad Musleh
(74) *Attorney, Agent, or Firm* — Leydig, Voit & Mayer, Ltd.

(57) ABSTRACT

A switching device having a magnetic release includes a yoke having a U-shaped first section that includes a first limb having an opening in the form of a slot open towards a free end of the first limb, a second limb disposed parallel to the first limb, and a web connecting the first and second limbs. The switching device also includes a coil including a coil former, a coil winding and an armature disposed between the first and second limbs, wherein the coil is insertable into the slot towards the web and the armature extends through the slot. A restraint spring is connected at a free end of the armature and disposed outside the first limb.

4 Claims, 4 Drawing Sheets

SWITCHING DEVICE

Priority is claimed to German Patent Application No. DE 10 2008 012 149.5, filed on Mar. 1, 2008, the entire disclosure of which is incorporated by reference herein.

The present invention relates to a switching device, in particular a motor circuit breaker. The invention also relates to a method for fitting the magnetic release of a motor circuit breaker.

BACKGROUND

Such a switching device has been disclosed in DE 199 35 662 A1.

The magnetic release for the electrical switching device has a yoke, which has a U-shaped first section with a first and a second limb, between which a coil with a coil winding, an armature and a coil former is arranged. In this case, the armature passes through an opening in the first limb of the U shape and is restrained with a restraint spring, which is connected at the free end of the armature outside of the first limb.

No mention is made in DE 199 35 662 A1 of the fitting of the armature together with the coil former.

SUMMARY OF THE INVENTION

An aspect of the invention is to provide a motor breaker and in particular a magnetic release in such a way that simple fitting of the armature with the coil and coil former is possible. A further aspect of the invention provides for a simple fitting method.

The present invention provides a switching device having a magnetic release and comprising a yoke having a U-shaped first section including a first limb having an opening in the form of a slot open towards a free end of the first limb, a second limb disposed parallel to the first limb, and a web connecting the first and second limbs; a coil including a coil former, a coil winding and an armature disposed between the first and second limbs, wherein the coil is insertable into the slot towards the web and the armature extends through the slot; and a restraint spring connected at a free end of the armature and disposed outside the first limb.

According to the present invention the opening is in the form of a slot which is open towards the free end of the first limb, with the result that the coil with the coil former can be or is inserted into the slot towards that web of the U shape which connects the two limbs to one another in the direction of longitudinal extent of the first limb, the armature passing through the slot.

In particular with the configuration of the opening as a slot, the fitting is considerably simplified since threading-in work of the armature into a closed opening no longer needs to be carried out.

In a particularly advantageous embodiment of the invention, this simplification is further assisted by the fact that the coil former has two radial flanges, of which the first flange bears against the inner surface of the second limb, and that pockets are provided in the second flange, in which pockets the prongs delimiting the slot engage.

In accordance with a further configuration of the invention, the diameter of the armature can be stepped and has a region with a relatively large diameter, which is located within the coil former, and a region with a relatively small diameter, which protrudes out of the first limb and on whose end the restraint spring acts.

As a result, an increase in the tripping force can be achieved since the region with the relatively large diameter is located in the interior of the coil.

The method for fitting the magnetic release with which the fitting can be carried out is characterized by the fact that, first, the coil former is wound with a coil, then the armature is inserted into the interior of the coil former, that, then, the coil former together with the armature and the coil is pushed onto the first limb of the yoke, and that, then, the restraint spring is pushed over the armature and fixed.

Further advantageous configurations and improvements of the invention are given in the claims.

BRIEF DESCRIPTION OF THE DRAWINGS

The invention and further advantageous configurations and improvements of the invention and further advantages will be explained and described in more detail with reference to the drawing, which illustrates an exemplary embodiment of the invention and in which.

DETAILED DESCRIPTION

Figure 1:
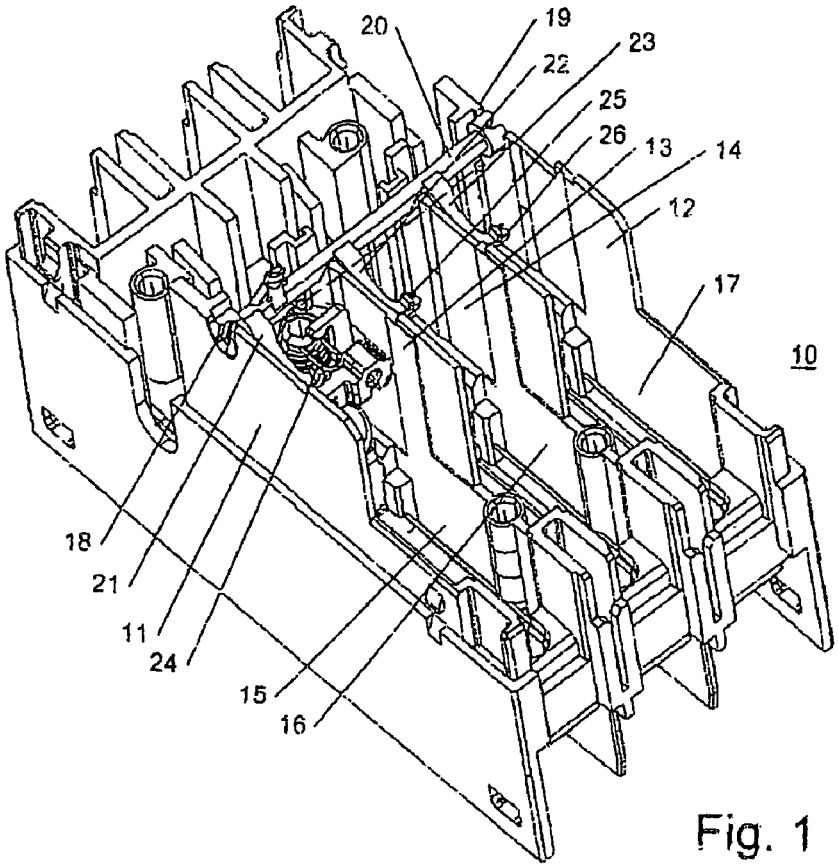
FIG. 1 shows a view into the housing lower part of a motor circuit breaker.
Figure 2:
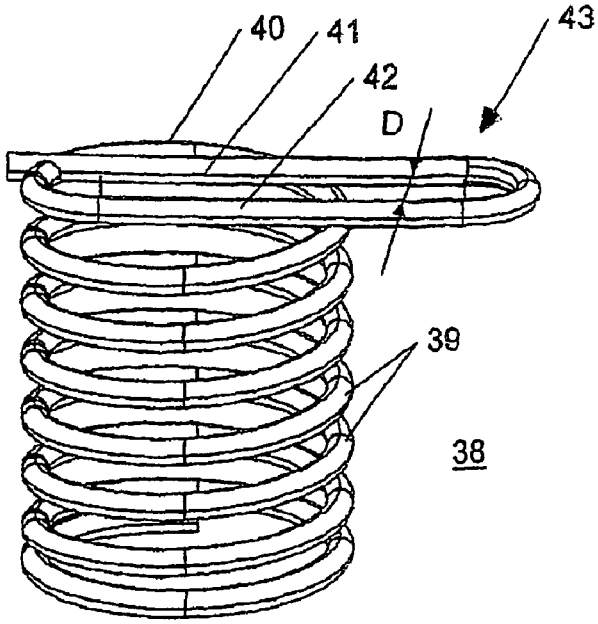
FIG. 2 shows a perspective view of a restraint spring.

FIG. 1 shows the housing lower part 10 of an electrical switching device, in this case of a motor circuit breaker, which is delimited by two parallel outer walls 11 and 12 and has intermediate walls 13 and 14, which form chambers 15, 16 and 17, in which electromagnetic releases and further components are located, the construction of the electromagnetic release being described in more detail with reference to FIGS. 2, 3 and 4.

In each case one bearing point 18, 19 for a pivoting shaft 20 is arranged in the two side walls 11 and 12, with arms 21, 22 and 23 being integrally formed on said pivoting shaft 20. The arms include respective projections 24, 25 and 26 and can be used to open a latching point in a switching mechanism in a manner not shown in any more detail.

This arrangement is prior art, as is apparent from DE 199 35 662 A1.

An electromagnetic release is used in FIG. 1; electromagnetic releases are also installed in the chambers 15 to 17. The further components, such as connection terminals, moveable contact pieces with contact links and the like, are not illustrated.

Figure 4:
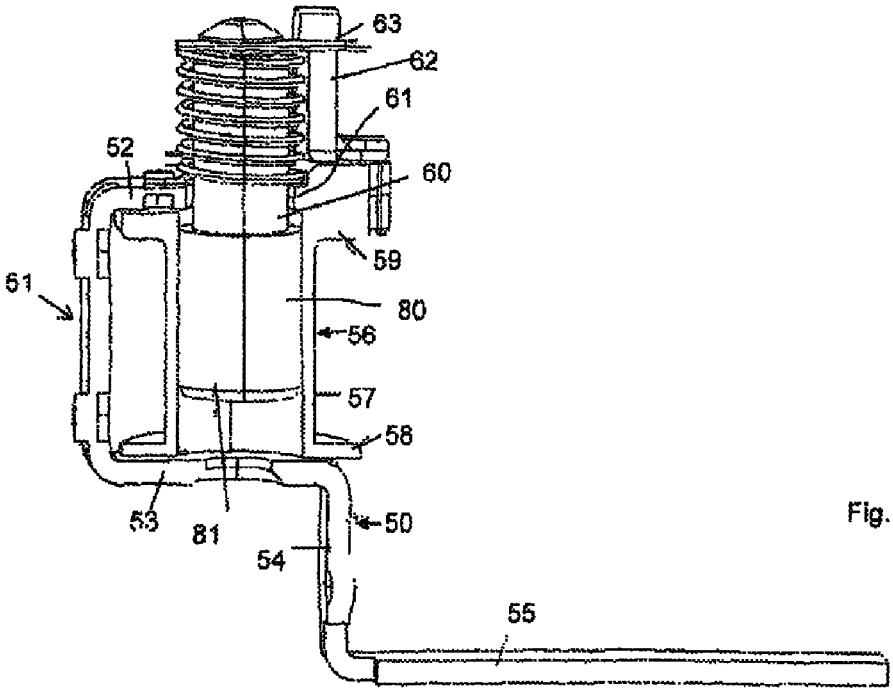
FIG. 4 shows a sectional view of the yoke with the coil, the coil former, the armature and the restraint spring.

Reference is now made to FIG. 4.

The electromagnetic release has a yoke 50, which has a U-shaped section 51, which has a first limb 52 and a second limb 53; a bent-back portion 54, which is bent back perpendicular to the second limb 53, is integrally formed at the free end of said second limb 53, with a holding limb 55 being integrally formed on said bent-back portion, on which holding limb a thermal release (not illustrated in the drawing) is fixed.

A coil 56 is inserted between the first and the second limbs 52, 53, which coil 56 has a coil former 57 with two radial flanges 58 and 59; a coil is wound around the coil former.

An armature 80, which has two sections 81 and 60 with different diameters, is located within the coil former 57; the first section 81 with the relatively large diameter is located completely within the coil former, whereas the second section 60 with the relatively small diameter protrudes out of the coil former 57 and in the process also protrudes beyond the first limb 52. The flange 59 is designed to be widened, in particular the axial thickness of the flange 59 being larger than the axial thickness of the flange 58. An inwardly projecting strip 61, which engages partially around the second section 60 of the armature, is provided in the region of the flange 59, on the inner side thereof. An arm 62, which protrudes in the longitudinal direction of the armature 80 and has a tab 63 at its free end, which tab 63 projects in the direction of the flange 59 and interacts with a restraint spring 38 (see FIG. 2), is integrally formed on the outer side of the flange 59.

The restraint spring 38 comprises a plurality of circular turns 39, which are associated with one another in helical fashion, the last turn 40 of which is deformed in oval fashion and has two limbs 41 and 42, which run perpendicular to the spring axis and span a plane which likewise runs perpendicular to the axis. The turn 40 with the two limbs 41 and 42 forms a projection 43, which protrudes radially beyond the envelope of the helical spring 38 or the restraint spring 38. With this subregion which protrudes beyond the envelope of the restraint spring 38, the restraint spring interacts with the tab 63 by virtue of the tab 63 engaging in the interspace between the limbs 41 and 42.

Figure 5:
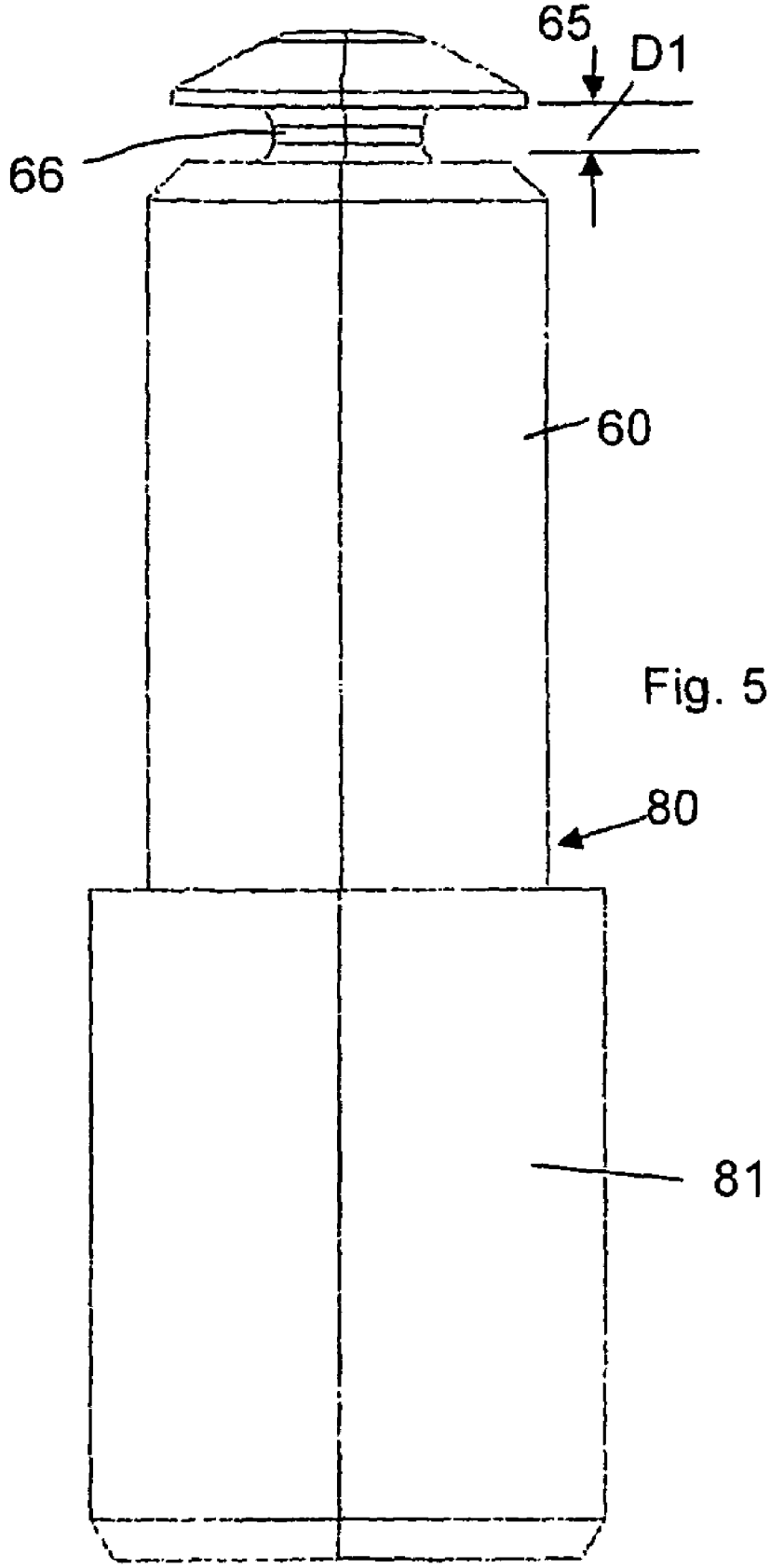
FIG. 5 shows a side view of an armature for the magnetic release.

As can be seen from FIG. 5, the armature 80 has, at the free end of the second section 60 with a relatively small diameter, a mushroom 65, which is arranged at a distance D1 from the free end region of the second section 60 and has a mushroom base 66 there between, to which mushroom base the mushroom 65 is connected with the second section 60. The outer diameter of the mushroom base 66 is dimensioned such that it can be surrounded by the two limbs 41, 42, with the result that these two limbs engage between the second section 60 and the mushroom 65 and in this way the restraint spring is coupled to the armature 80.

Figure 3:
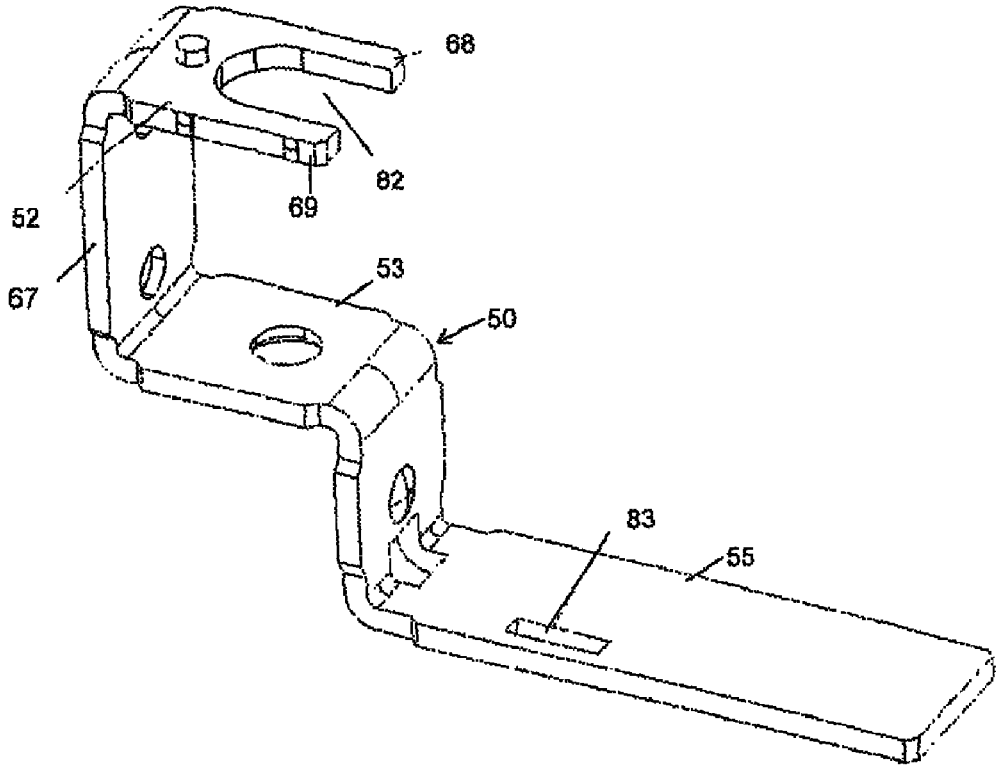
FIG. 3 shows a perspective view of a yoke.

Reference will now be made to FIG. 3, which merely illustrates the yoke 50 without additional elements.

Figure 6:
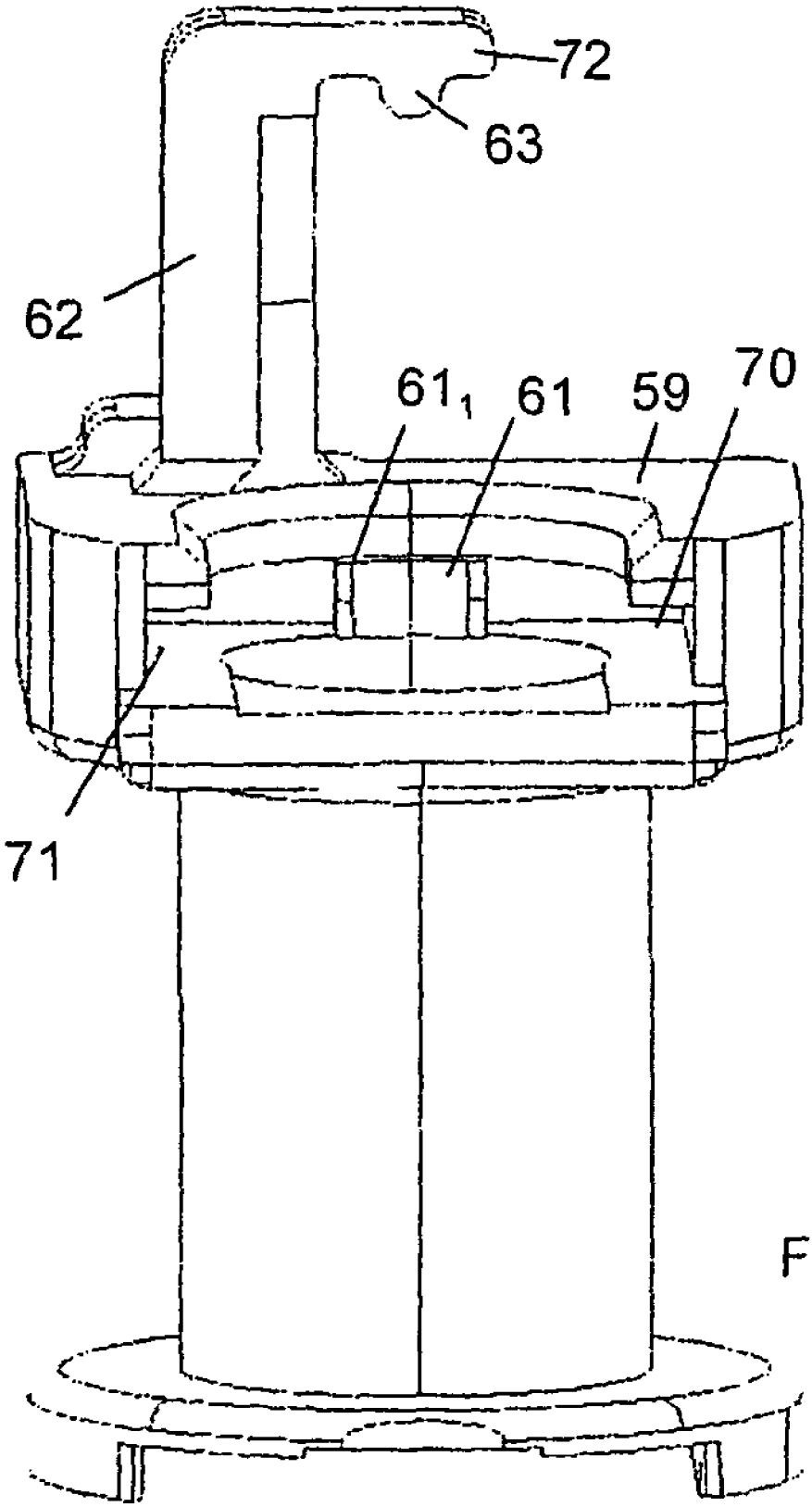
FIG. 6 shows a perspective view of the coil former for the magnetic release.

The first limb 52 has an opening 82, which is in the form of an open slot, with the result that the coil former, together with the coil and the armature, can be pushed in parallel to the longitudinal extent of the limb 52 towards the web 67, which connects the two limbs 52 and 53 to one another, by virtue of the prongs 68 and 69 being capable of being pushed into pockets 70, 71 (see FIG. 6) provided in the flange 59. FIG. 6 also shows the arm 62 with the tab 63, which is arranged on an L limb 72 of the arm so as to project towards the flange 59. The tab 63 engages in the interspace between the turns 40 and 41, as can be seen in FIG. 4.

As a result, the fitting of the coil former is considerably simplified.

The advantage of the stepped armature consists in the fact that the region with the relatively large diameter, which runs within the coil, attains a relatively large magnetic force; by virtue of the fact that a relatively large quantity of iron is used, saturation is achieved later, with the result that stronger and earlier attraction takes place given the same currents, in comparison with an armature which has an outer diameter which is not stepped.

For fitting purposes, first the armature 80 is pushed into the coil former 57, with naturally the coil previously having been wound around the coil former 57. Then, the coil former 57 with the armature inserted is pushed into the yoke or into the slot 82 by virtue of the prongs 68 and 69 engaging in the pockets 70 and 71 dimensioned for this purpose; in the process, the armature part which protrudes beyond out of the coil former, i.e. the second section 60 with the relatively small diameter, is inserted through the opening of the slot into said slot; then the restraint spring 38 is plugged onto the section 60, which protrudes beyond the coil former 57 or the flange 59, the two turns 40, 41 latching into the region of the mushroom base 66 and the projection of the turns 40, 41 being laid behind the tab 63.

The strip 61 on the coil flange delimits the movement of the armature 80 towards the first limb 52.

As can be seen from FIG. 6, the strip 61 only covers a subregion of the inner diameter, with the result that only this small subregion with the step $\mathbf{61}_1$ is used for guiding the restraint spring 38.

FIG. 3 shows a slot 83 in the limb 55, and the base of a bimetallic strip, which runs perpendicular to the limb 55, is inserted into this slot 80 and fixed therein.

List of Reference Symbols

| | |
|---|---|
| 10 | Housing lower part |
| 11 | Outer wall |
| 12 | Outer wall |
| 13 | Intermediate wall |
| 14 | Intermediate wall |
| 15 | Chamber |
| 16 | Chamber |
| 17 | Chamber |
| 18 | Bearing point |
| 19 | Bearing point |
| 20 | Pivoting shaft |
| 21 | Arm |
| 22 | Arm |
| 23 | Arm |
| 38 | Restraint spring |
| 39 | Turn |
| 40 | Last turn |
| 41 | Turn limb |
| 42 | Turn limb |
| 43 | Projection |
| 50 | Yoke |
| 51 | U-shaped yoke section |
| 52 | First limb |
| 53 | Second limb |
| 54 | Perpendicular bent-back portion |
| 55 | Holding limb |
| 56 | Coil |
| 57 | Coil former |
| 58 | Radial flange of coil former |
| 59 | Radial flange of coil former |
| 60 | Second armature section |
| 61 | Strip |
| 62 | Arm |
| 63 | Tab |
| 65 | Mushroom |
| 66 | Mushroom base |
| 67 | Web |
| 68 | Prongs |
| 69 | Prongs |
| 70 | Pocket in flange |
| 71 | Pocket in flange |
| 72 | L limb |
| 80 | Armature |
| 81 | First armature section |
| 82 | Opening in first limb |
| 83 | Slot |

What is claimed is:

1. A switching device having a magnetic release, the switching device comprising:

a yoke having a U-shaped first section including a first limb having an opening in the form of a slot open towards a free end of the first limb, a second limb disposed parallel to the first limb, and a web connecting the first and second limbs;

a coil including a coil former, a coil winding and an armature disposed between the first and second limbs, wherein the coil is insertable into the slot towards the web and the armature extends through the slot; and a restraint spring connected at a free end of the armature and disposed outside the first limb, wherein the coil former has a first radial flange disposed against an inner surface of the second limb and a second radial flange disposed against an inner surface of the first limb and having pockets, and wherein the first limb includes first and second prongs disposed on each side of the opening and engaging the pockets.

2. The switching device as recited in claim 1, wherein the armature includes a first region with a first diameter protruding out of the first limb and a second region with a second diameter larger than the first diameter and located within the coil former, and wherein the free end is an end of the first region.

3. The switching device as recited in claim 1, wherein the switching device is a motor circuit breaker.

4. A method for fitting a magnetic release in a switching device, the switching device including a yoke having a U-shaped first section with a first limb having an opening in the form of slot open towards a free end of the first limb and first and second prongs disposed on each side of the opening, a second limb disposed parallel to the first limb, and a web connecting the first and second limb, the method comprising:

winding a coil around a coil former, the coil former having a first radial flange and a second radial flange including pockets;

inserting an armature into an interior of the coil former;

inserting the coil former, the armature, and the coil into the slot in the first limb so as to dispose the coil former and coil between the first and second limbs with the armature extending through the slot, the first radial flange disposed against an inner surface of the second limb, and the second radial flange disposed against an inners surface of the first limb with the first and second prongs disposed in the pockets of the coil former, and disposing a restraint spring over the armature.

* * * * *